US010272288B2

(12) United States Patent
Brown

(10) Patent No.: US 10,272,288 B2
(45) Date of Patent: Apr. 30, 2019

(54) ROLLING, MULTI-DIRECTIONAL FITNESS DEVICE

(71) Applicant: Luke F. Brown, Seattle, WA (US)

(72) Inventor: Luke F. Brown, Seattle, WA (US)

( * ) Notice: Subject to any disclaimer, the term of this patent is extended or adjusted under 35 U.S.C. 154(b) by 0 days.

(21) Appl. No.: 15/879,309

(22) Filed: Jan. 24, 2018

(65) Prior Publication Data

US 2018/0185702 A1 Jul. 5, 2018

Related U.S. Application Data

(63) Continuation-in-part of application No. 14/487,307, filed on Sep. 16, 2014, now abandoned, which is a continuation-in-part of application No. 13/546,193, filed on Jul. 11, 2012, now abandoned.

(51) Int. Cl.

| | |
|---|---|
| ***A63B 22/20*** | (2006.01) |
| ***A63B 21/00*** | (2006.01) |
| ***A63B 23/02*** | (2006.01) |
| ***A63B 23/12*** | (2006.01) |
| ***A63B 23/035*** | (2006.01) |
| ***A63B 21/015*** | (2006.01) |
| ***A63B 21/068*** | (2006.01) |

(52) U.S. Cl.

CPC ..... *A63B 22/20* (2013.01); *A63B 21/0004* (2013.01); *A63B 21/00069* (2013.01); *A63B 21/015* (2013.01); *A63B 21/068* (2013.01); *A63B 21/4034* (2015.10); *A63B 21/4035* (2015.10); *A63B 23/0216* (2013.01); *A63B 23/0355* (2013.01); *A63B 23/03541* (2013.01); *A63B 23/1236* (2013.01); *A63B 23/03525* (2013.01); *A63B 2208/0295* (2013.01); *A63B 2209/00* (2013.01); *A63B 2210/00* (2013.01); *A63B 2210/50* (2013.01); *A63B 2225/30* (2013.01)

(58) Field of Classification Search

CPC ..... A63B 22/20; A63B 22/201; A63B 22/203; A63B 22/205; A63B 23/0205; A63B 23/1236

See application file for complete search history.

(56) References Cited

U.S. PATENT DOCUMENTS

| | | | | |
|---|---|---|---|---|
| 3,809,393 | A | 5/1974 | Jones | |
| 4,892,305 | A * | 1/1990 | Lynch | A63B 22/20 482/132 |
| 6,575,883 | B1 | 6/2003 | Hinds | |
| 6,602,170 | B2 | 8/2003 | Ilic | |
| 6,773,379 | B1 | 8/2004 | Bing | |
| 7,468,025 | B2 | 12/2008 | Hauser et al. | |
| 7,481,753 | B2 | 1/2009 | James et al. | |
| 7,563,216 | B1 | 7/2009 | Kest | |
| 7,621,858 | B2 | 11/2009 | Sherron | |
| D654,545 | S * | 2/2012 | Richard | D21/662 |

(Continued)

*Primary Examiner* — Nyca T Nguyen

(74) *Attorney, Agent, or Firm* — Clark A. Puntigam; Jensen & Puntigam, P.S.

(57) ABSTRACT

Ball cup assemblies positioned in the four corners of a main body having an open center area and a handle spanning the opening. A roller ball is positioned in each of the ball assemblies, ball bearings are positioned between the housing and the roller ball, held in place by a binder ring. A retainer ring is attached to the lower peripheral surface of the ball housing.

5 Claims, 15 Drawing Sheets

(56) References Cited

U.S. PATENT DOCUMENTS

| | | | | |
|---|---|---|---|---|
| 2005/0209072 | A1* | 9/2005 | Sheron | A63B 21/0618 482/132 |
| 2006/0101614 | A1* | 5/2006 | Sellars | B60B 33/08 16/25 |
| 2009/0298656 | A1* | 12/2009 | Dannenberg | A63B 22/14 482/141 |
| 2010/0004105 | A1 | 1/2010 | Peddar | |
| 2013/0123079 | A1* | 5/2013 | Peritz | A63B 22/14 482/139 |

* cited by examiner

ROLLING, MULTI-DIRECTIONAL FITNESS DEVICE

This is a continuation-in-part application of U.S. patent application Ser. No. 14/487,307 filed Sep. 16, 2014, which is a continuation-in-part of U.S. patent application Ser. No. 13/546,193 filed Jul. 11, 2012.

TECHNICAL FIELD

The invention relates to exercise, strength, physical therapy and endurance and offers a multi-functional device to aid in a variety of exercise training programs.

BACKGROUND OF THE INVENTION

Devices designed to increase muscle mass, strength and endurance are commonplace. Many such devices are technically designed to work a specific muscle or set of muscles and are commonly used in fitness centers and training facilities. Home fitness devices, portable fitness devices and personal fitness devices are also common.

Muscle fibers within complex muscle groups relax and contract in a number of different directions depending on their point of connection to the body's skeleton. Devices designed to roll, rotate, rock and spin in conjunction with the physiology of the body's natural movements can dramatically aid in the ability of a user to increase muscle flexion and contraction during body-weight exercise repetitions.

Exemplary in this regard are various fitness devices disclosed in the following U.S. patents and patent publications:

U.S. Pat. No. 6,602,170 to Ilic discloses a torso exercising apparatus and system for performing various calisthenics and maneuvers to tone and build the body. Right and left handles of the apparatus are disposed between two respective pairs of spaced-apart, front and rear rollers. Each of the roller pairs is affixed to a base. The handles are each disposed on a diagonal with respect to their respective front and rear roller pairs. The diagonally oriented handles eliminate wrist strain and have a further advantage of facilitating sideways movement.

U.S. patent application Ser. No. 12/493,320 to Peddar discloses an exercising device, and a method of use, configured to perform upper body and abdominal type exercise. The exercise device includes a pad member configured to support a forearm of a user. The exercise device also includes a handle extending from a tip surface of the pad member about a front end of the pad member and configured to provide a grip for a hand. In addition, the exercise device includes a selectably coupleable attachment member that includes a plurality of wheels. The exercise device further includes a tongue and groove attachment member configured to selectably couple the attachment member to the pad member.

U.S. Pat. No. 6,773,379 to Bing discloses an exercise device for the upper torso of a user that includes a base, a plurality of wheel assemblies, and a handle assembly. The base is equilateral triangular-shaped and has an uppermost surface and a lowermost surface. The handle assembly is swively positioned in the uppermost surface of the base so as to allow the handle assembly to achieve a desired hand position relative to the plurality of wheel assemblies. The plurality of wheel assemblies are three and in combination with the base being equilateral triangular-shaped, prevent rocking. Each wheel assembly is rotatably mounted in the lowermost surface of the base.

U.S. Pat. No. 6,575,883 to Hinds discloses a wheel and axle exercising assembly with which the operator is positioned horizontally, either face up or face down and moves the assembly forward and backward either feet first, having the feet at the assembly, by thrusting the legs forward and then retracting them; or hands first, having the hands at the assembly, by thrusting the arms forward and then retracting them. Adjustment means are present to position the foot emplacement assemblies either closer to or farther from the wheel.

U.S. Pat. No. 7,563,216 to Kest discloses an exercise device wherein various embodiments of this invention disclose a push up exercise device with a rocker, a balance indicator and a hinged balance roller.

U.S. Pat. No. 3,809,393 to Jones discloses an exercising device in the form of a handle supported by at least three swivel casters and adapted to be moved about a floor while supporting the upper body of a person in use. The handle defines a longitudinal axis around which the swivel casters are symmetrically and fixedly disposed. Additionally, the handle has a girth, which enables circumferential gripping by an adult hand.

U.S. Pat. No. 7,621,858 to Sherron discloses an invention that provides an exercise apparatus with a hemispherical support frame and a rigid ball mounted to the support frame with a low-friction bearing system in between the ball and the support frame so that the ball is freely rotatable in any direction. In one embodiment, the bearing system comprises a plurality of ball bearings and a retainer. The present invention also provides for an exercise system with two omnidirectional rolling apparatuses and a band that tethers the pair of apparatuses. The present invention also provides for methods of using the apparatus and system to perform isotonic exercises.

U.S. Pat. No. 7,481,753 to James and Hegge discloses a rotatable push-up exercise device for aiding a user in performing push-up type exercises. The device has a platform rotatably mounted on a base. The platform may selectively be held stationary or may be free to rotate when performing push-up exercises. The device includes a gripping bar mounted on the platform. The base is adapted to rest on a support surface, such as the floor. A pair of exercise devices are normally utilized together. In use, the user grasps the gripping bar of each device with one hand and performs push-up exercises. Due to the rotation of the support surface with respect to the base, the user is forced to exercise the shoulders and other muscle groups in the user's body, in addition to the arm and chest muscles, in order to maintain a stable position.

U.S. Pat. No. 7,468,025 to Hauser, Friedman and Mills discloses a push-up exercise unit which may enable a user to move with his/her body's natural rotation to engage additional muscle groups with reduced stress on joints. The device can include a handle support structure having a pair of columns between a lower base and a separate end cap such that the handle intersects a corresponding end cap and upper portion of a corresponding column of the handle support structure. The device includes a fixed base support attached to the handle support structure, and a bearing assembly to permit rotation of the contiguous handle, end caps and handle support structure by a user with the base support resting on a planar surface. In another example, the handle assembly is detachable from a first surface on the handle support structure and inserted into a second surface to facilitate stowage for travel.

Although a vast array of fitness devices have been invented and introduced to the market, there is still need in the art for a new and improved device that is simple to use, is small and portable in size and offers increased functionality and effectiveness over other devices or fitness systems. This invention meets those needs.

SUMMARY OF THE INVENTION

Accordingly, the fitness device comprises a main body portion having an open center area, a handle portion spanning the open area, and a plurality of roller balls assemblies, each roller ball assembly including a housing with an extending post which fits into a mating part in the main body portion; a roller ball positioned in the housing; a plurality of loose ball bearings between the roller ball and an interior surface of the housing; a bearing ring connected to or part of a lower peripheral edge of the housing, holding the bearings in place; and a retainer ring which is connected to the lower peripheral edge of the housing, and in contact with the surface of the roller ball and the bearing ring, in a relationship allowing the roller ball to move freely.

BRIEF DESCRIPTION OF THE DRAWINGS

The drawings are intended to be illustrative and symbolic representations of certain exemplary embodiments of the present invention and as such they are not necessarily drawn to scale.

DETAILED DESCRIPTION OF THE INVENTION

In brief, the multi-directional rolling fitness device is a small and portable exercise system that allows for a full-body workout nearly anywhere. Used as a pair, or individually, a preferred embodiment of the invention comprises a handle assembly (or stirrup for the feet), a base unit and a plurality of ball-transfer units. The invention allows a user to perform a nearly unlimited number of exercise movements to strengthen muscles and increase endurance.

The handle assembly allows a user to grip the device for use. The handle assembly in a preferred embodiment comprises a grip section for the hands and a pair of vertical supports that attach the grip section to the base unit. In a further embodiment, the handle assembly comprises a stirrup that accepts the foot, or offers an interchangeable grip section and a foot stirrup for dual functionality between the hands and feet. The grip section of the handle assembly is mounted to the vertical supports with bearing structures to allow rotation of the grip section about its axis.

The base unit is a structural member designed to connect a plurality of ball transfer units and further allows for the attachment of the handle assembly. The shape of the base unit in a preferred embodiment is similar to an X, with somewhat parallel surfaces on top and bottom when viewed on profile. In an alternate embodiment, the base unit could be rectangular when viewed from the top or bottom.

A plurality of ball transfer units is attached to the base unit allowing the device to roll in multiple directions across a floor or other surface during exercise repetitions. In a preferred embodiment, four ball-transfer units with bearings are utilized to maximize stability during exercises. In a further embodiment one or more of the ball-transfer units is engineered with a "brake" mechanism that contacts the roller-ball with user-adjusted variable pressure, thereby increasing the difficulty of exercise repetitions.

In a still further embodiment, the ball transfer units include encircling bearings to prevent side movement while permitting free wheeling and a top bearing to prevent drag. The ball transfer units are of a non-marring material or have a non-marring surface and are held in place with a snap-on or screw-on fastener to permit access for cleaning.

These and other aspects of the present invention will become more evident upon reference to the following detailed description and attached drawings. It is to be understood, however, that various changes, alterations, and substitutions may be made to the specific embodiments disclosed herein without departing from their essential spirit and scope.

Figure 1:
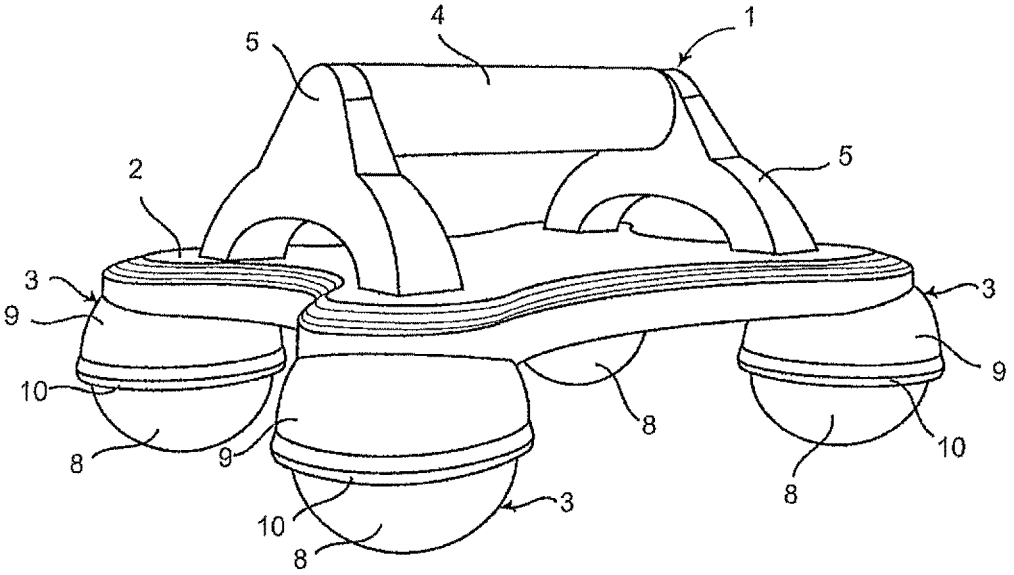
FIG. 1 illustrates an isometric view of a preferred embodiment of the invention.

As best shown in FIG. 1, the invention comprises a handle assembly 1, a base unit 2 and a plurality of ball-transfer units 3.

Figure 5:
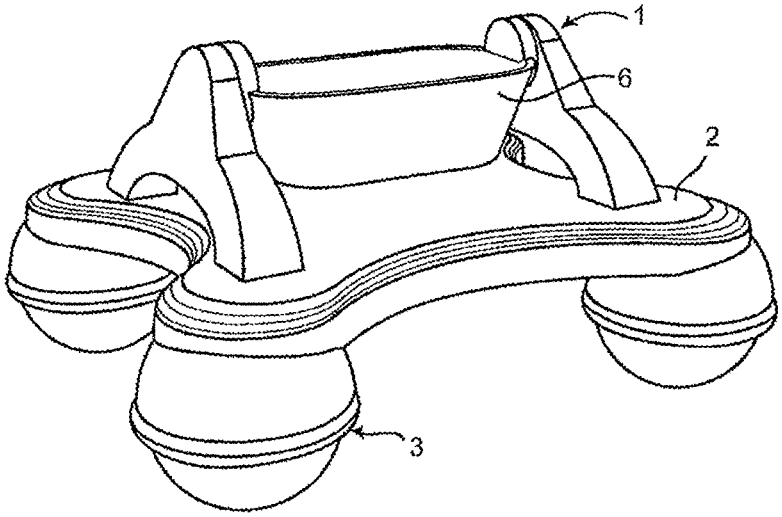
FIG. 5 illustrates a further embodiment of the grip section comprising a foot stirrup.
Figure 5A:
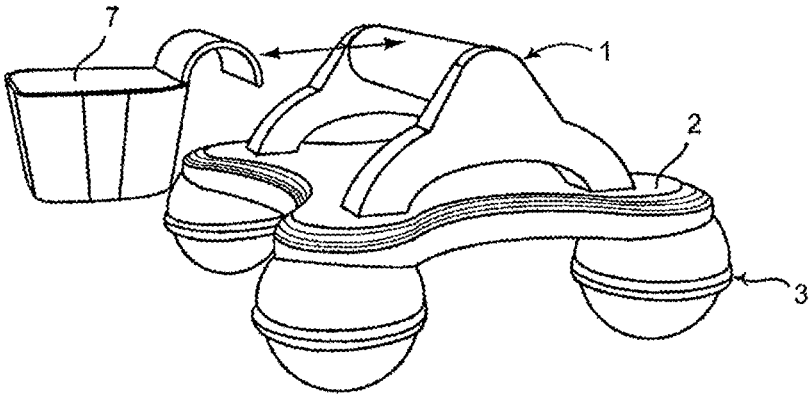
FIG. 5*a* illustrates a further embodiment of the invention wherein the invention further comprises a removable foot stirrup, shown removed.
Figure 6:
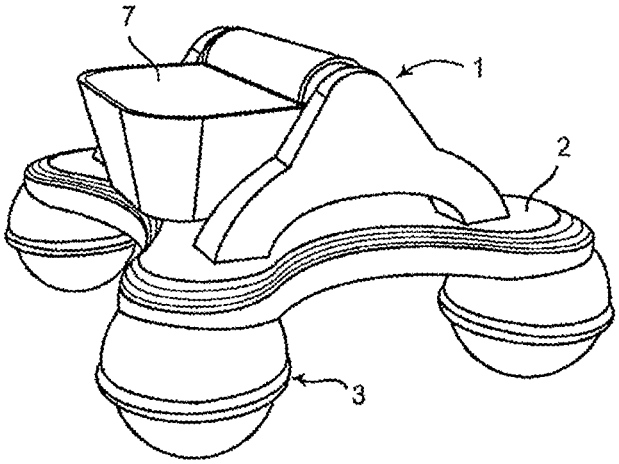
FIG. 6 illustrates a further embodiment of the invention wherein the invention further comprises a removable foot stirrup, shown attached.
Figure 8:
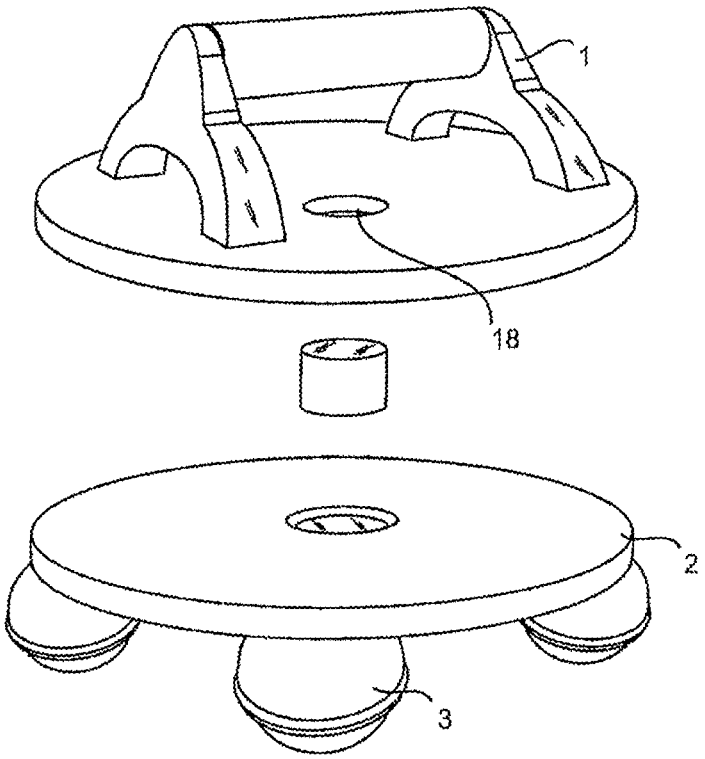
FIG. 8 shows an exploded view of an alternative embodiment wherein the handle assembly is designed to spin around a single point relative to the base unit.
Figure 8A:
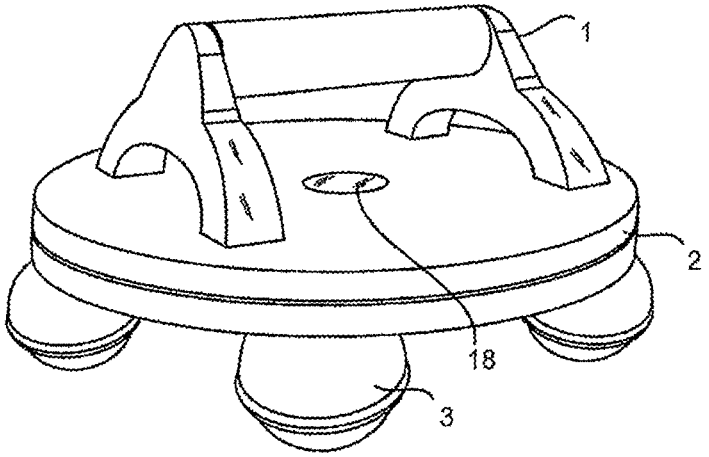
FIG. 8*a* shows an alternative embodiment wherein the handle assembly is designed to spin around a single point relative to the base unit.
Figure 9:
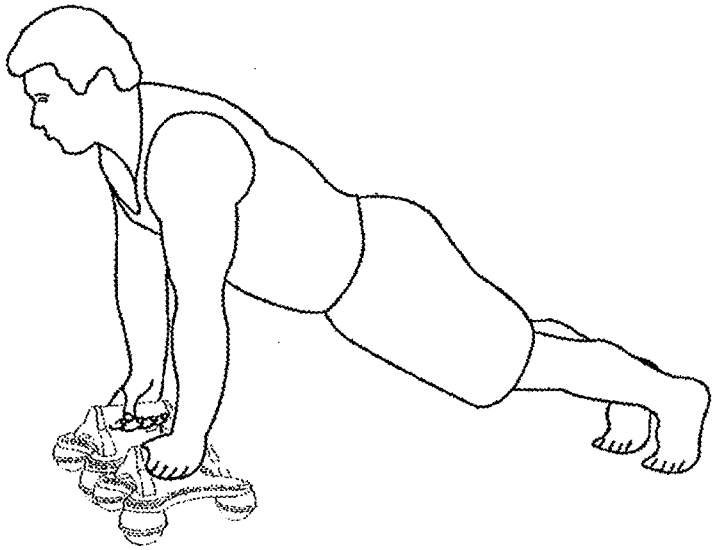
FIG. 9 illustrates a user with a pair of the devices in a preferred embodiment in the starting position for a typical push-up movement.
Figure 9A:
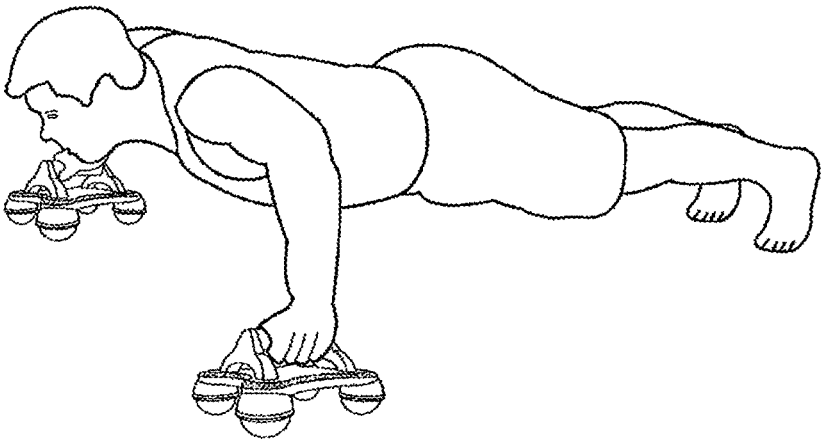
FIG. 9*a* illustrates a user with a pair of the devices in a preferred embodiment in the lowered position of a typical push-up and chest fly movement, highlighting the ability of the user to allow the devices to travel away from each other to a wide position during the exercise movement.
Figure 10:
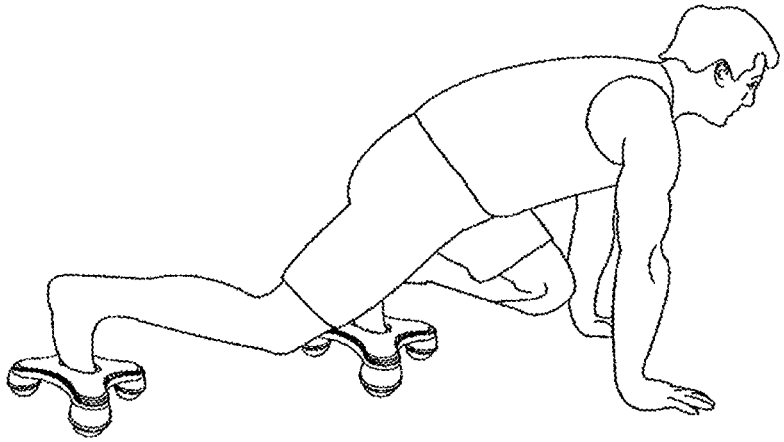
FIGS. 10 and 10*a* illustrate a user utilizing a pair of the devices embodied with a recess to receive the foot. In this embodiment, the user is able to exercise many muscles in the lower body, abs and core by alternating the movement of the feet forward and backward with the hands stably supporting the upper body on the floor.
Figure 10A:
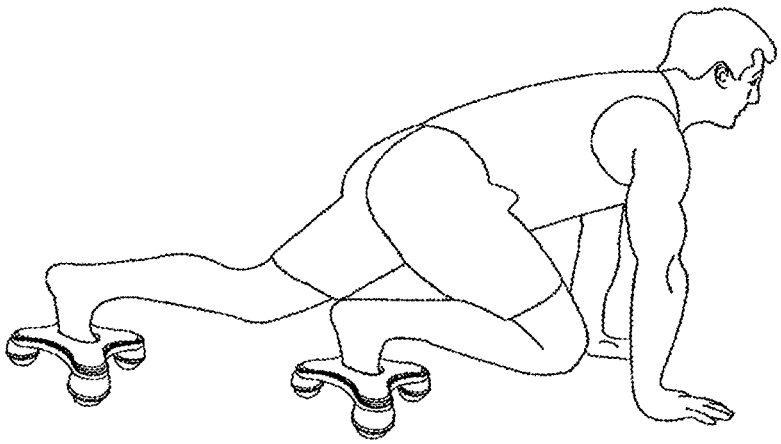

The handle assembly 1 is the point at which a user engages the device with the hands or feet for use. In a preferred embodiment, and as best shown in FIG. 1, a grip section 4 attaches at each end to a vertical support 5 that further attach to the base unit 2. The grip section 4 may be solidly affixed to said vertical supports 5, or may spin freely, with a tubular grip 4 slidably engaged over a dowel further attached at each end to the vertical supports 5. Or, in further embodiments, the grip section 4 can be dowel shaped and spin within a circular recess in each vertical support 5, or by way of a bearing at the attachment point between the grip section 4 and the vertical supports 5. In a further embodiment, FIGS. 8, 8*a* the entire handle assembly 1 can rotate freely around a central point of connection 18 on the base unit 2. In a further embodiment, and as best shown in FIGS. 5, 5*a* and 6, the handle assembly grip comprises a stirrup 6 that accepts the foot or is interchangeable with a removably attachable stirrup 7 that accepts the foot allowing a user to switch between exercises while using the device with the hands or the feet. The entire handle assembly 1, 6, 7 can be designed to be removable for storage. Any of the components of the handle assembly 1 can most easily be manufactured by way of plastic injection molding, however construction from wood, metal or any other machinable or moldable solid material would be suitable. Fabric or webbing material would also be suitable for constructing the foot stirrup 6, 7.

Figure 3:
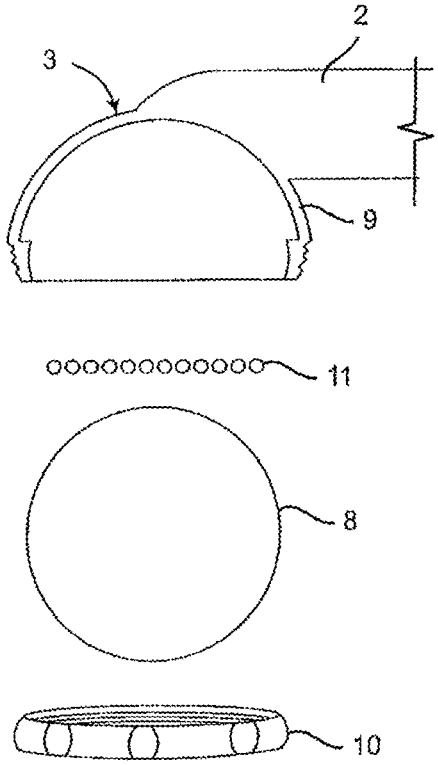
FIG. 3 illustrates an exploded view and individual components of a single ball transfer unit.
Figure 3A:
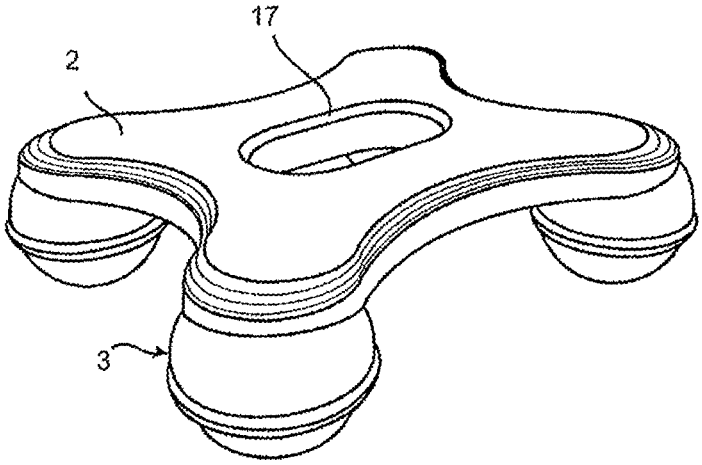
FIG. 3*a* illustrates a further embodiment of the invention comprising a base unit with a recess designed for use with the feet.
Figure 4:
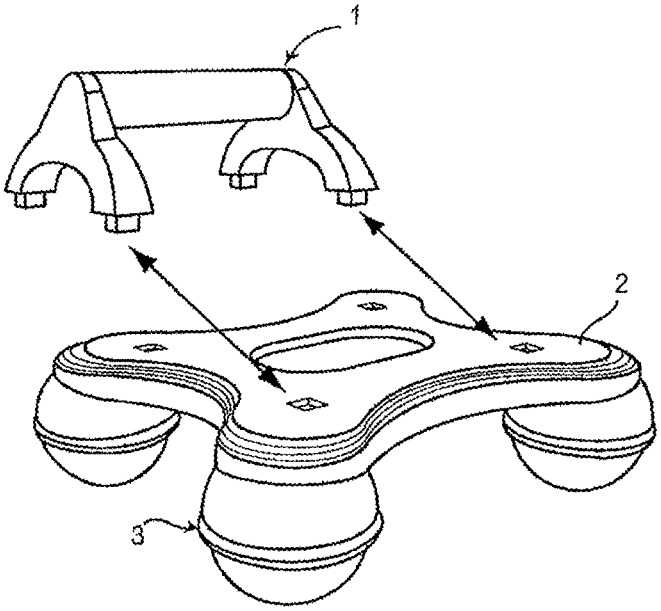
FIG. 4 illustrates a further embodiment of the invention comprising a base unit with a recess, and a removable handle assembly shown in the removed position.
Figure 4A:
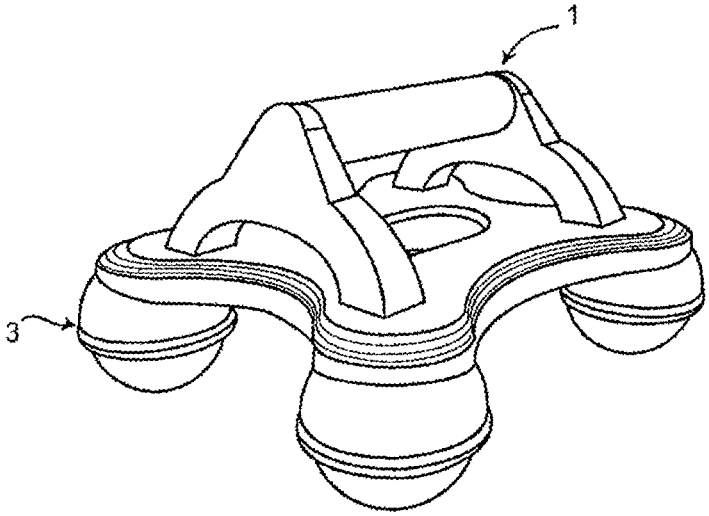
FIG. 4*a* illustrates a further embodiment of the invention comprising a base unit with a recess and a removable handle assembly shown in the attached position.

As best shown in FIG. 1, the base unit 2 is a structural member of the invention designed to connect two or more of the ball transfer units 3 to each other, and further allows for integration or attachment of the handle assembly 1 or grip section 4. In a preferred embodiment, and as best shown in FIG. 1, the shape of the base unit 2 is similar to the letter "X" with somewhat parallel surfaces top and bottom when viewed in profile, however the exterior form and shape of the base unit can vary greatly in alternative embodiments without changing the device's functionality, and can be embodied to be circular FIG. 8, 8*a*, square, frame-like, round, oval, triangular or diamond shaped, and could be further embodied as shown in FIG. 3*a* to comprise a hole or recess 17 to receive the foot of a user. The base unit 2 is most easily manufactured by way of plastic injection molding, however construction from wood, metal or any other machinable or moldable solid material would be suitable.

Figure 2:
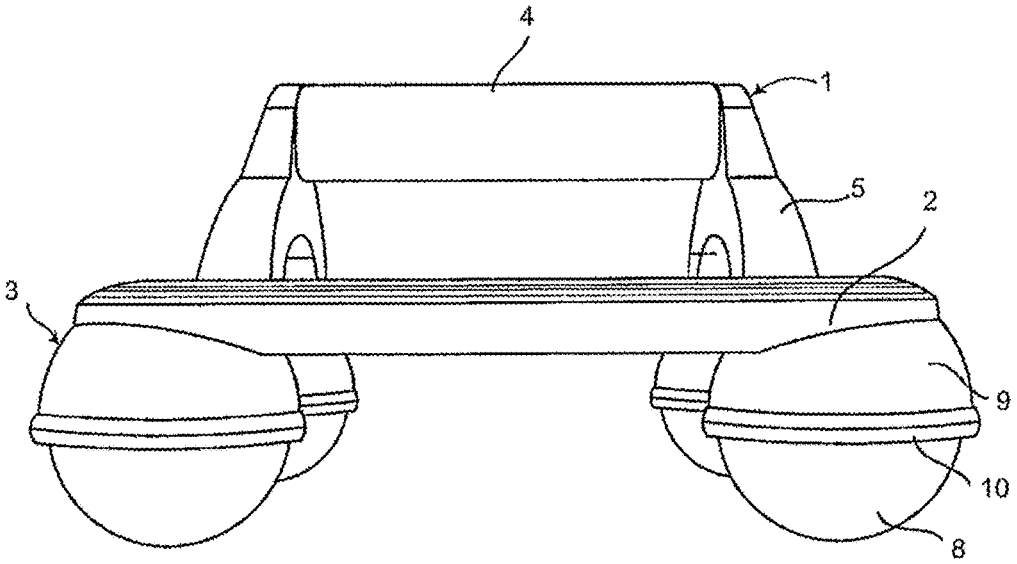
FIG. 2 illustrates a side view of the preferred embodiment of the invention.
Figure 2A:
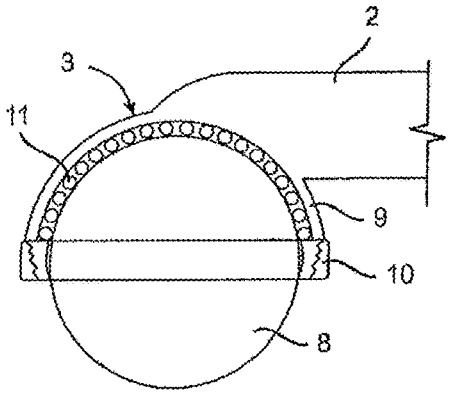
FIG. 2*a* illustrates a cross section of a single ball transfer unit including bearings.

As best shown in FIG. 1, a plurality of ball transfer units 3 are attached to the base unit 2, allowing the device to roll across the floor or other surface during exercise repetitions. The preferred embodiment integrates four ball-transfer units 3 to maximize stability during exercises, though fewer than four, or more than four would also work effectively. In a preferred embodiment, and as best shown in FIGS. 2*a*, 3 the ball transfer units 3 comprise a firm rubber roller ball 8, in an effort to select a material that can be safely used on nearly any floor or other surface, a ball transfer housing 9 and a screw cap 10 that secures the roller ball 8 in place. The screw cap can be integrated into the design of the ball transfer unit as well, as long as the shape sufficiently secures the roller ball 8 in place. In a preferred embodiment, and as best shown in FIGS. 2*a* and 3, the ball transfer units 3 include at least one friction reducing ball bearing 11 arranged between the ball transfer housing 9 and the roller ball 8.

Figure 6A:
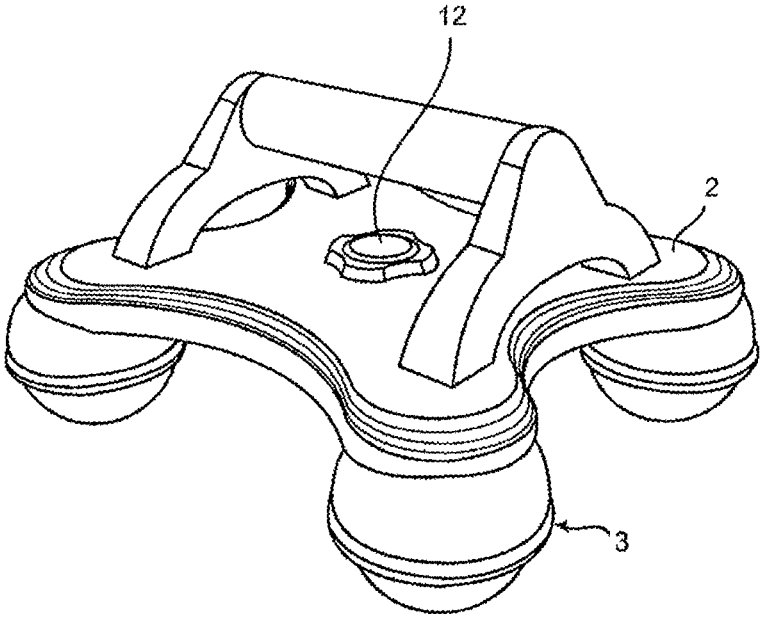
FIG. 6*a* illustrates a further embodiment of the invention wherein a brake unit knob is shown on the surface of the base unit.
Figure 7:
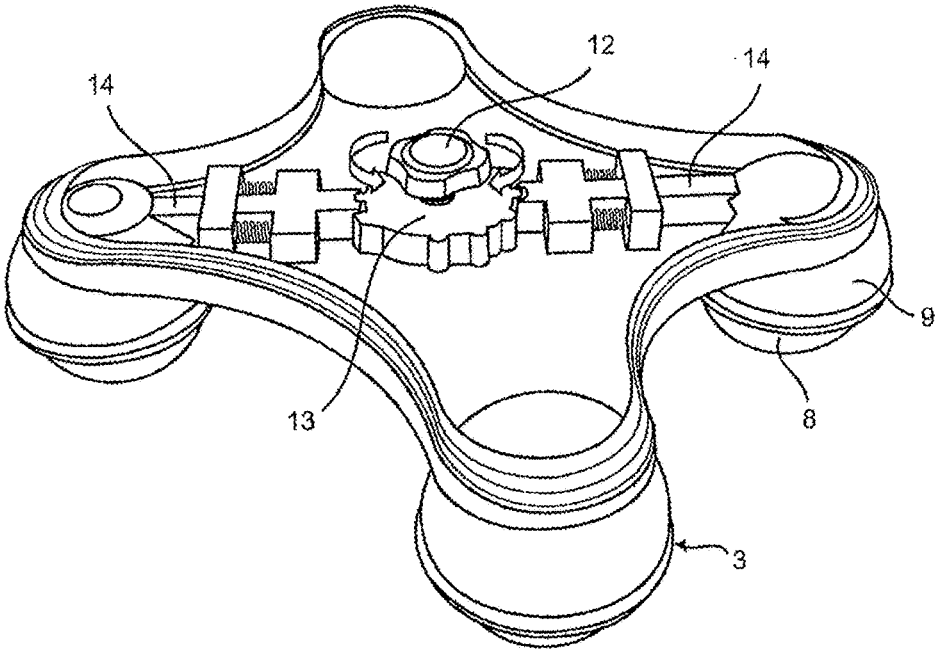
FIG. 7 illustrates a cut-away view of the components of a cam mechanism brake option that allows for user adjustable variability in repetition difficulty.
Figure 7A:
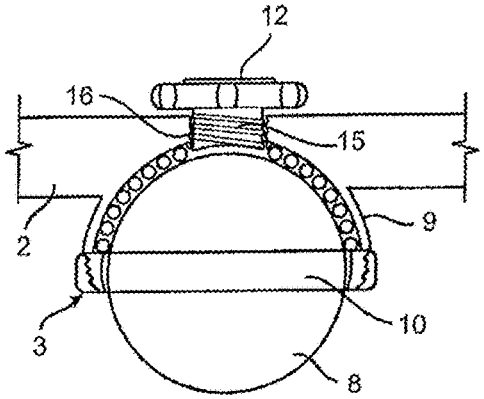
FIG. 7*a* illustrates an alternative embodiment of a brake option that can be applied to one or more of the device's ball transfer units.

In another embodiment, and as best shown in FIGS. 6*a*, 7 and 7*a*, the device comprises a user adjustable brake to increase or decrease the difficulty of repetitions. In a potential brake embodiment, and as shown in FIGS. 6*a* and 7, the brake is constructed as a simple cam mechanism, which allows a user to turn a knob 12 on the base unit 2, which connects to a variably shaped cam profile 13 that in turn pushes the cam following arm(s) 14 through the ball transfer housing 9, and against the roller ball(s) 8 with variable pressure at a number of different settings. A neutral starting point offers no contact and no resistance, while further settings allow incrementally increasing levels of pressure and corresponding resistance during exercise repetitions. In another brake embodiment, and as shown in FIG. 7*a* the brake unit may further comprise a hand-knob 12 attached to a through-bolt 15 that penetrates the ball-transfer housing 9 by way of threaded grooves 16. Turning the hand knob 12 allows the end of the through-bolt to contact the roller ball 8 adding user-adjusted variable pressure. In another embodiment, (not shown) pressure on the roller ball 8 can be variably adjusted by turning the screw cap 10 on one or more of the ball transfer units 3. In this embodiment, the screw cap 10 comprises an interior shape that tapers to contact the roller ball 8 when the screw cap 10 is threaded more tightly to the ball transfer housing 9. Components of the ball transfer units 3 as well as components of the brake are most easily manufactured by way of injection-molded plastic. However, wood, metal, rubber or any other machinable or moldable solid material would be suitable.

Exemplary of the preferred embodiment and as best shown in FIG. 1, the invention's base unit 2 is about 10 inches long and about 9 inches wide with a handle assembly grip section 4 that measures about 6 inches long and is about 1.5 inches in diameter. The ball transfer units' 3 roller ball(s) 8 measure about 2.5 inches in diameter.

Figure 11:
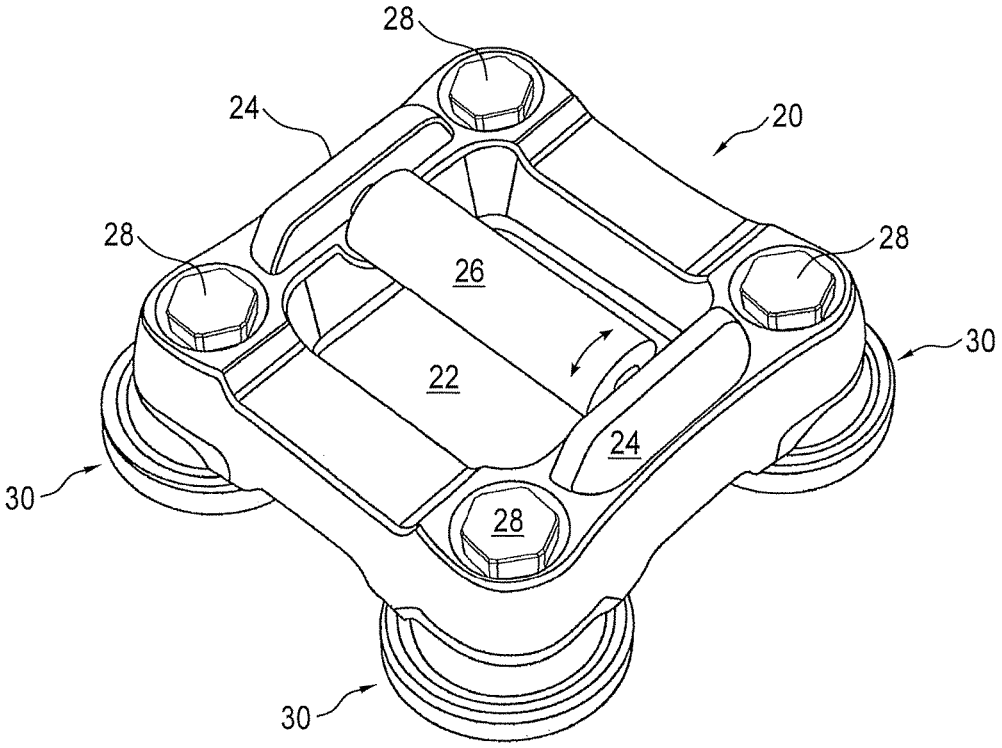
FIG. 11 illustrates a perspective view of another embodiment of the invention, including a rotating hand grip and recessed foot cradle.
Figure 12:
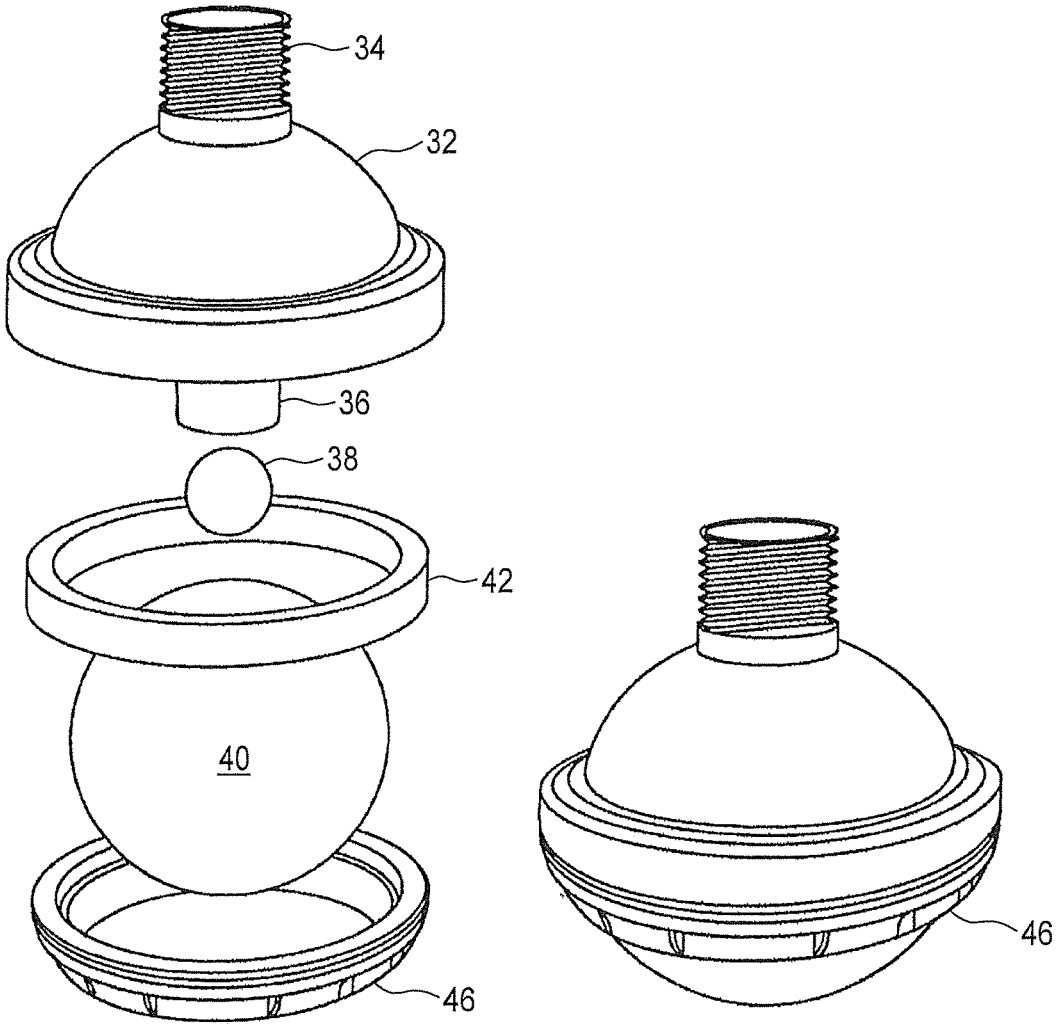
FIG. 12 illustrates both an assembled and top perspective exploded view of a ball transfer unit.
Figure 13:
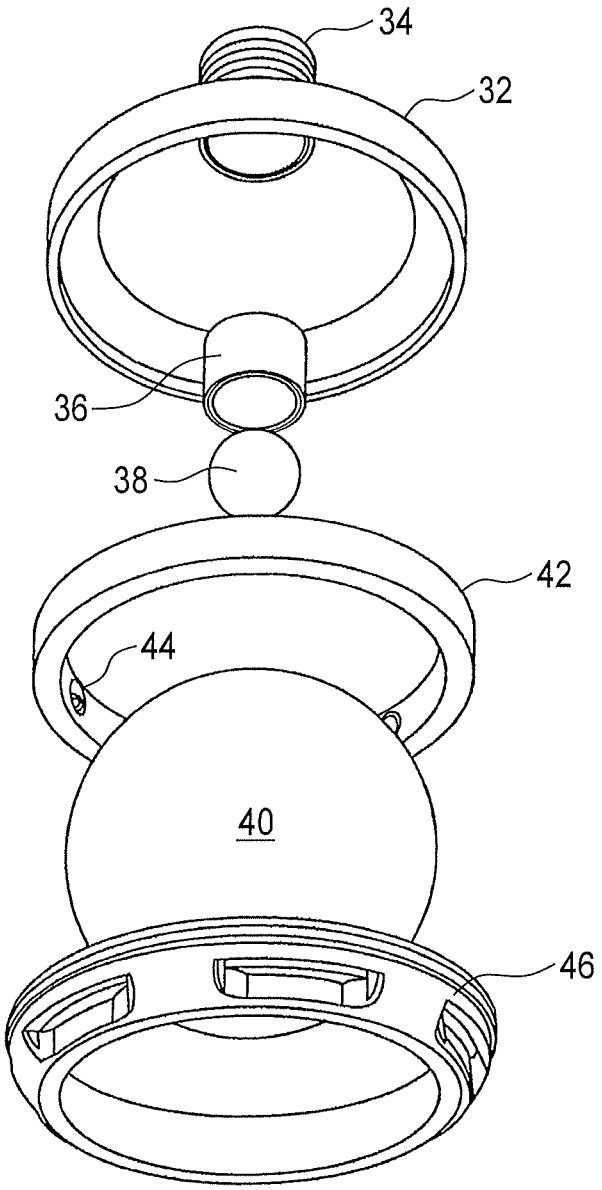
FIG. 13 illustrates a bottom perspective view of the ball transfer unit.

In a still further embodiment seen in FIGS. 11-13, the base unit 20 includes a recessed central portion 22, a pair of upstanding vertical supports 24 and a handle 26. It is to be understood that handle 26 is preferably cylindrical and is rotatable about its axis.

Also seen in FIG. 11 are a plurality of threaded cap nuts 28 used to secure the ball transfer units 30 in place.

Reference is now to FIGS. 12 and 13. Ball transfer units 30 are shown in greater detail and comprise a cap 32 including an upwardly extending threaded portion 34 to mate with cap nuts 28, a downwardly extending bearing housing 36, a bearing ball 38, a roller ball 40, a cylindrical bearing ring 42 including a plurality of captured radially inwardly facing ball bearings 44 (see FIG. 13) and a readily removable securement ring 46. It is to be noted that securement ring 46 includes external threads to mate with the internal threads of cap 32, but the interconnection could also be a snap fastener or friction fit, allowing removal for cleaning.

Figure 14:
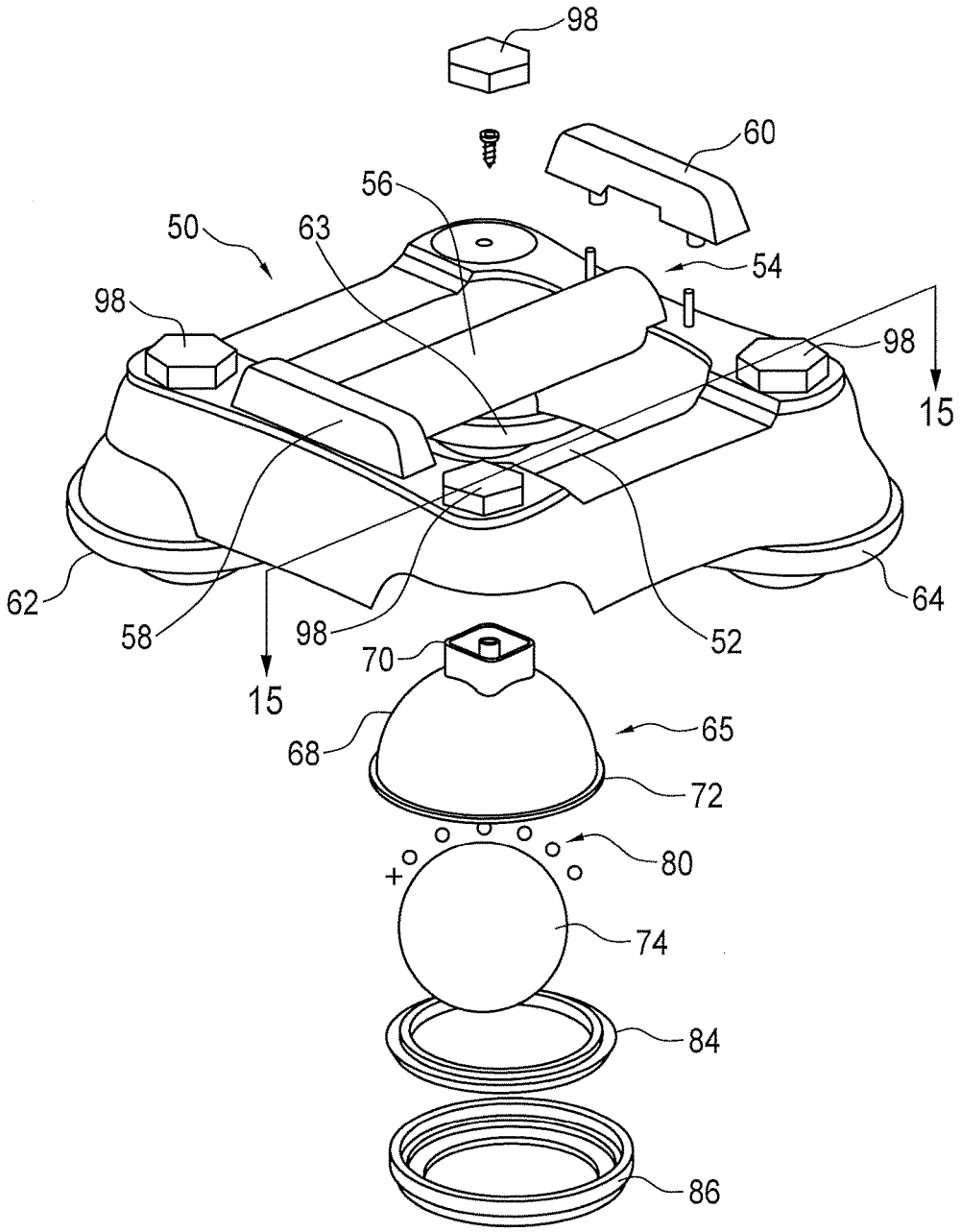
FIG. 14 illustrates a further embodiment of the present invention.
Figure 15:
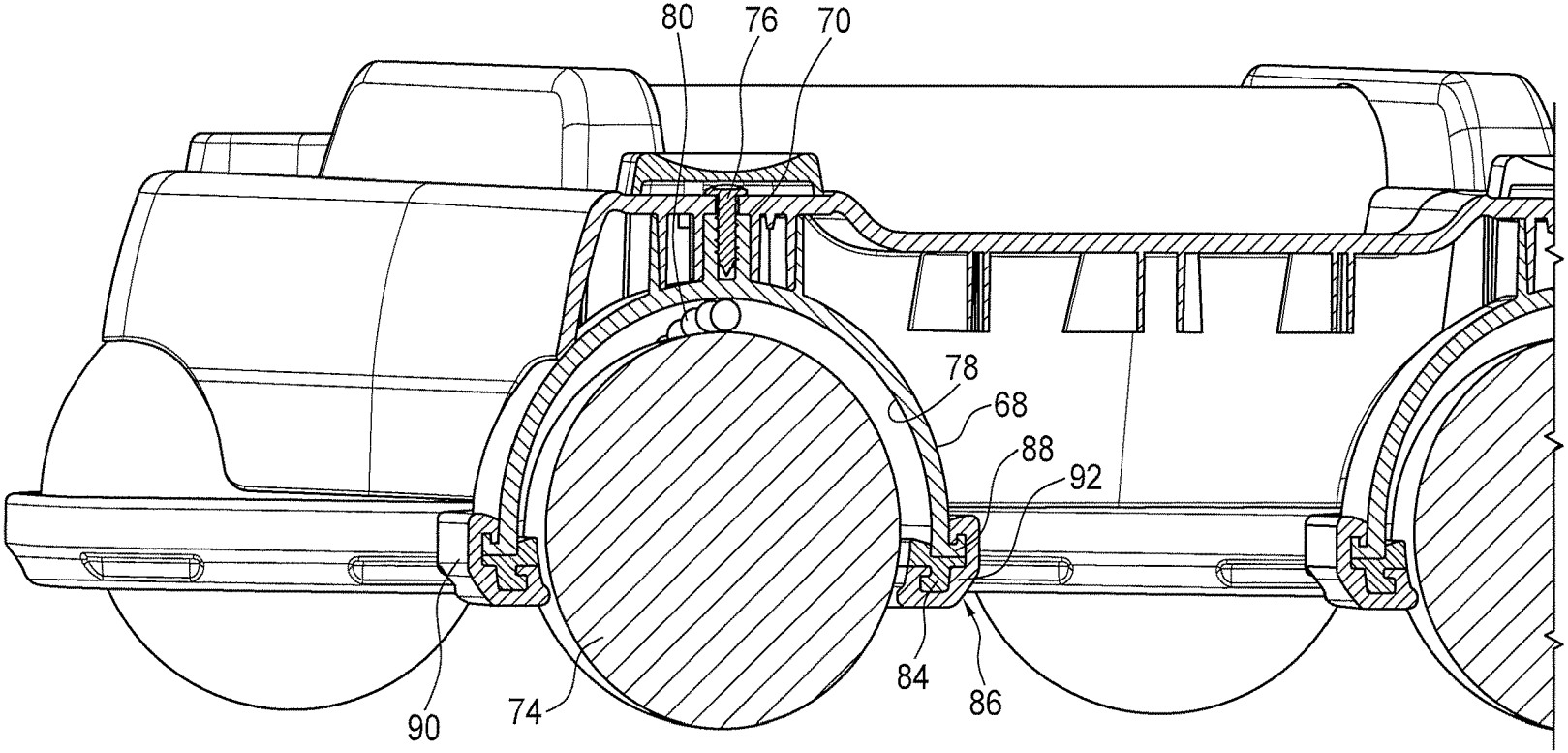
FIG. 15 is a cross-section of the embodiment of FIG. 14 taken along lines 15-15 thereof.

FIGS. 14 and 15 show a further embodiment of the present invention. FIG. 14 shows a base unit 50 which is typically injection molded of plastic. Base unit 50 includes an open center portion 52, allowing a foot of the user to be inserted into the base unit. Attached to the top of the base unit is a handle 54 comprising a cylindrical grip portion 56 and two spaced, fixed supports 58-60 which are attached to an upper surface of base unit 50, such as by screws. Grip portion 56 is typically rotatable within the supports 58 and 60. The above elements are similar to previous embodiments such as shown, for instance in FIGS. 12 and 13.

The embodiment includes four ball transfer units 62-65 located at the four corners of the base unit. Each ball transfer unit includes an upper housing 68 with a square post 70 extending from the upper surface thereof. The upper housing is partially spherical, terminating in a lower circular rim 72. The post 70 extends upwardly into a mating receiving portion in the lower surface of the base unit 50. The post is secured in the receiving portion by adhesive. A screw 76 is used to further attach the upper housing to the base unit such that it remains fixedly in place. The post could also be sonic welded to the base unit.

A roller ball 74 fits into the upper housing 68 with a plurality of ball bearings 80-80 positioned in the space between the surface of the roller ball and the interior surface 78 of the upper housing. The ball bearings cover only a portion of the volume, permitting the ball bearings to constantly move during use of the article and allowing the roller ball to find its path of least resistance as it moves by action of the user. A bearing ring 84 is positioned about the roller ball, in slideable contact with the surface of the roller ball and further in contact with the lower rim of the upper housing. The bearing ring 84 maintains the ball bearings in place between the surface of the roller ball and the interior surface of the upper housing. In the current embodiment, the bearing ring is sonic welded to the lower rim of the upper housing.

A lower retainer ring 86 is snap fitted onto a flange portion 88 of the lower edge of the upper housing. The lower retainer ring secures the roller ball 74 and the bearing ring 84 in place in the upper housing. It has an outer surface 90 which acts as a bumper during use. The bearing ring 84 includes a depending portion 92 which snaps into a channel 84 present in lower retainer ring 86 which is flexible. The lower retainer ring and the bearing ring act with the lower edge of the upper housing to maintain the ball bearings in place between the roller ball surface and the interior surface of the housing, i.e. within the volume between the roller ball and the upper housing. Typically, the ball bearings will occupy approximately 75% of this volume, although this can vary. This arrangement of each of the ball transfer units allow the four roller balls to move easily in various directions in action of the article.

Positioned on the top surface of the base unit 50, at the corners thereof, are cosmetic caps 98-98. These cosmetic caps snap or glue on after the fasteners 76 are installed, and have a surface, generally concave, which permits several fitness devices to be conveniently stacked, with the lower edge of the roller balls nesting into the concave upper surface caps of an adjacent fitness device.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore indicated by the appended claims rather than by the foregoing descriptions, and all changes that come within the meaning and range of equivalency of the claims are to be embraced within their scope.

What is claimed is:

1. A multi-directional fitness device, comprising:

a main body portion having an open center area, a handle portion spanning the open area, and a plurality of roller ball assemblies, each roller ball assembly including a housing with an extending post which fits into a mating part in the main body portion;

a roller ball positioned in the housing;

a plurality of loose ball bearings between the roller ball and an interior surface of the housing;

a bearing ring connected to or part of a lower peripheral edge of the housing, holding the bearings in place; and a retainer ring which is connected to the lower peripheral edge of the housing, and in contact with the surface of the roller ball and the bearing ring, in a relationship allowing the roller ball to move freely, wherein the retainer ring is flexible and removable from the lower edge of the housing.

2. The fitness device of claim 1 including a single layer of ball bearings between the housing and the roller ball.

3. The fitness device of claim 1, wherein the extending post is square in outline and is a mating receptacle in the main body portion.

4. The fitness device of claim 1, including a fastener between the main body portion and the extending post.

5. The fitness device of claim 1, including a cosmetic cap at four corners of the upper surface of the main body portion, configured to allow the device to nest vertically.

* * * * *